US010208614B2

(12) United States Patent
Hafner et al.

(10) Patent No.: US 10,208,614 B2
(45) Date of Patent: Feb. 19, 2019

(54) APPARATUS, TURBINE NOZZLE AND TURBINE SHROUD

(71) Applicant: GENERAL ELECTRIC COMPANY, Schenectady, NY (US)

(72) Inventors: Matthew Troy Hafner, Honea Path, SC (US); Gary Michael Itzel, Simpsonville, SC (US); Sandip Dutta, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 385 days.

(21) Appl. No.: 15/054,346

(22) Filed: Feb. 26, 2016

(65) Prior Publication Data

US 2017/0248029 A1 Aug. 31, 2017

(51) Int. Cl.
*F01D 11/00* (2006.01)
*F01D 9/04* (2006.01)
(Continued)

(52) U.S. Cl.
CPC ..... *F01D 11/005* (2013.01); *F01D 9/041* (2013.01); *F01D 9/065* (2013.01); *F01D 25/08* (2013.01);
(Continued)

(58) Field of Classification Search
None
See application file for complete search history.

(56) References Cited

U.S. PATENT DOCUMENTS 4,613,280 A * 9/1986 Tate ..... F01D 11/005 415/110
5,154,577 A * 10/1992 Kellock ..... F01D 11/005 277/641
(Continued)

FOREIGN PATENT DOCUMENTS

EP 1 445 537 A2 8/2004
EP 2 728 125 A1 5/2014
(Continued)

OTHER PUBLICATIONS

Extended European Search Report and Opinion issued in connection with corresponding EP Application No. 17157099.7 dated Aug. 8, 2017.

*Primary Examiner* — David E Sosnowski
*Assistant Examiner* — Juan G Flores
(74) *Attorney, Agent, or Firm* — McNees Wallace & Nurick LLC

(57) ABSTRACT

Apparatuses are disclosed including a first article, a second article, a sewing member and a thermal break. The second article includes a second material composition having a second thermal tolerance greater than a first thermal tolerance of a first material composition of the first article. The sealing member is disposed between and contacts the first article and the second article, and includes a third material composition having a third thermal tolerance less than the second thermal tolerance and less than an operating temperature of the second article. The thermal break is defined by the second article, and is proximate to the sealing member and partitioned from the sealing member by a portion of the second article. The thermal break interrupts a thermal conduction path from the second article to the sealing member. The first article and the second article
(Continued)

compress the sealing member, forming a thermal gradient-tolerant seal.

20 Claims, 5 Drawing Sheets

(51) Int. Cl.
*F01D 25/08* (2006.01)
*F01D 9/06* (2006.01)
*F01D 25/12* (2006.01)
*F01D 5/18* (2006.01)

(52) U.S. Cl.
CPC ..... *F01D 25/12* (2013.01); *F01D 5/18* (2013.01); *F05D 2230/642* (2013.01); *F05D 2240/11* (2013.01); *F05D 2240/128* (2013.01); *F05D 2240/55* (2013.01); *F05D 2260/2212* (2013.01); *F05D 2260/231* (2013.01); *F05D 2300/175* (2013.01); *F05D 2300/603* (2013.01); *F05D 2300/6033* (2013.01)

(56) References Cited

U.S. PATENT DOCUMENTS

| | | | | |
|---|---|---|---|---|
| 6,076,835 | A | 6/2000 | Ress et al. | |
| 6,170,831 | B1 * | 1/2001 | Bouchard | F01D 11/005 277/355 |
| 6,758,653 | B2 | 7/2004 | Morrison | |
| 9,476,316 | B2 * | 10/2016 | Hillier | F01D 5/284 |
| 2014/0255170 | A1 * | 9/2014 | Hillier | F01D 5/284 415/174.2 |

FOREIGN PATENT DOCUMENTS

| | | | |
|---|---|---|---|
| EP | 2 775 103 | A2 | 9/2014 |
| WO | 2015/088869 | A1 | 6/2015 |

* cited by examiner

APPARATUS, TURBINE NOZZLE AND TURBINE SHROUD

STATEMENT REGARDING FEDERALLY SPONSORED RESEARCH OR DEVELOPMENT

The United States Government retains license rights in this invention and the right in limited circumstances to require the patent owner to license others on reasonable terms by the terms of Government Contract No. DE-FE0024006 awarded by the United States Department of Energy.

FIELD OF THE INVENTION

The present invention is directed to apparatuses, turbine nozzles, and turbine shrouds. More particularly, the present invention is directed to apparatuses, turbine nozzles, and turbine shrouds including thermal breaks proximate to sealing members forming thermal-gradient-tolerant seals.

BACKGROUND OF THE INVENTION

Gas turbines operate under extreme conditions. In order to drive efficiency higher, there have been continual developments to allow operation of gas turbines at ever higher temperatures. As the temperature of the hot gas path increases, the temperature of adjacent regions of the gas turbine necessarily increase in temperatures, due to thermal conduction from the hot gas path.

In order to allow higher temperature operation, some gas turbine components, such as nozzles and shrouds, have been divided such that the higher temperature regions (the fairings of the nozzles and the inner shrouds of the shrouds) may be formed from materials, such as ceramic matrix composites, which are especially suited to operation at extreme temperatures, whereas the lower temperature regions (the outside and inside walls of the nozzles and the outer shrouds of the shrouds) are made from other materials which are less suited for operation at the higher temperatures, but which may be more economical to produce and service.

Joining the portions of gas turbines in higher temperature regions to the portions of gas turbines in lower temperature regions may present challenges, particularly with regard to interfaces which include seals. Seals will contact both the higher temperature portions and the low temperature portions, and therefore are subjected to heat conduction from the hotter portion of the turbine to the cooler portion of the turbine. Certain types of seals which have beneficial properties, such as elastic or spring-like seals, may be unsuitable for operation in contact with the higher temperature portions, as these seals may creep at the elevated temperatures, resulting in degradation of operational characteristics.

BRIEF DESCRIPTION OF THE INVENTION

In an exemplary embodiment, an apparatus includes a first article, a second article, a sealing member and a thermal break. The first article includes a first material composition having a first thermal tolerance. The second article includes a second material composition having a second thermal tolerance greater than the first thermal tolerance. The sealing member is disposed between and contacts the first article and the second article, and includes a third material composition having a third thermal tolerance less than the second thermal tolerance. The third thermal tolerance is less than an operating temperature of the second article. The thermal break is defined by the second article, and is proximate to the sealing member and partitioned from the sealing member by a portion of the second article. The thermal break interrupts a thermal conduction path from the second article to the sealing member. The first article and the second article compress the sealing member, forming a thermal gradient-tolerant seal.

In another exemplary embodiment, a turbine nozzle includes an outside wall, a fairing, a sealing member, and a thermal break. The outside wall includes a metal having a first thermal tolerance. The fairing includes a ceramic matrix material composite having a second thermal tolerance greater than the first thermal tolerance. The sealing member is disposed between and contacts the outside wall and the fairing, and includes a third material composition having a third thermal tolerance less than the second thermal tolerance. The third thermal tolerance is less than an operating temperature of the fairing. The thermal break is defined by the fairing as a channel, and is proximate to the sealing member and partitioned from the sealing member by a portion of the fairing. The thermal break interrupts a thermal conduction path from the fairing to the sealing member. The outside wall and the fairing compress the sealing member, forming a thermal gradient-tolerant seal.

In another exemplary embodiment, a turbine shroud includes an outer shroud, an inner shroud, a sealing member, and a thermal break. The outer shroud includes a metal having a first thermal tolerance. The inner shroud includes a ceramic matrix material composite having a second thermal tolerance greater than the first thermal tolerance. The sealing member is disposed between and contacts the outer shroud and the inner shroud, and includes a third material composition having a third thermal tolerance less than the second thermal tolerance. The third thermal tolerance is less than an operating temperature of the inner shroud. The thermal break is defined by the inner shroud as a channel, and is proximate to the sealing member and partitioned from the sealing member by a portion of the inner shroud. The thermal break interrupts a thermal conduction path from the inner shroud to the sealing member. The outer shroud and the inner shroud compress the sealing member, forming a thermal gradient-tolerant seal.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary apparatuses and gas turbine components, such as turbine nozzles and turbine shrouds. Embodiments of the present disclosure, in comparison to articles and methods not utilizing one or more features disclosed herein, decrease costs, increase efficiency, improve seal integrity at elevated temperatures, improve elevated temperature performance, or a combination thereof.

Figure 1:
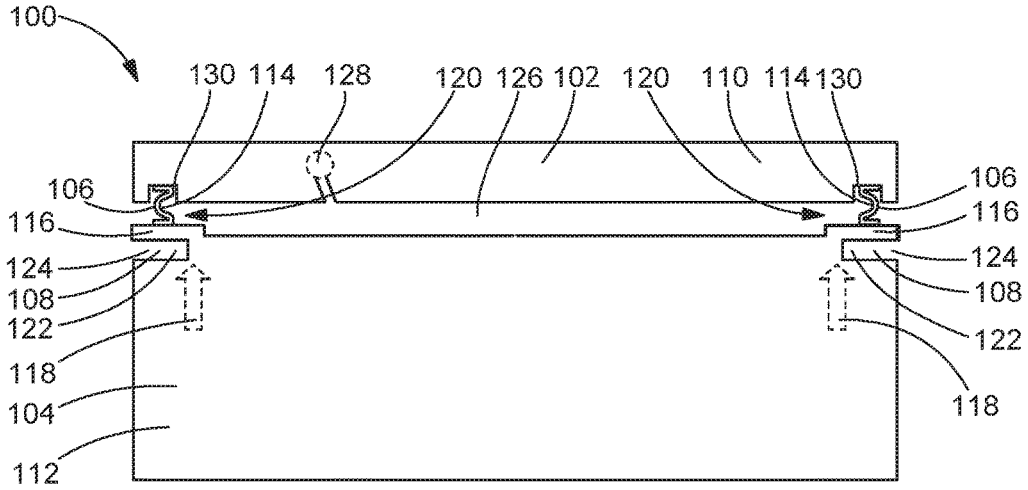
FIG. 1 is a schematic sectioned view of an apparatus including open channels, according to an embodiment of the present disclosure.
Figure 2:
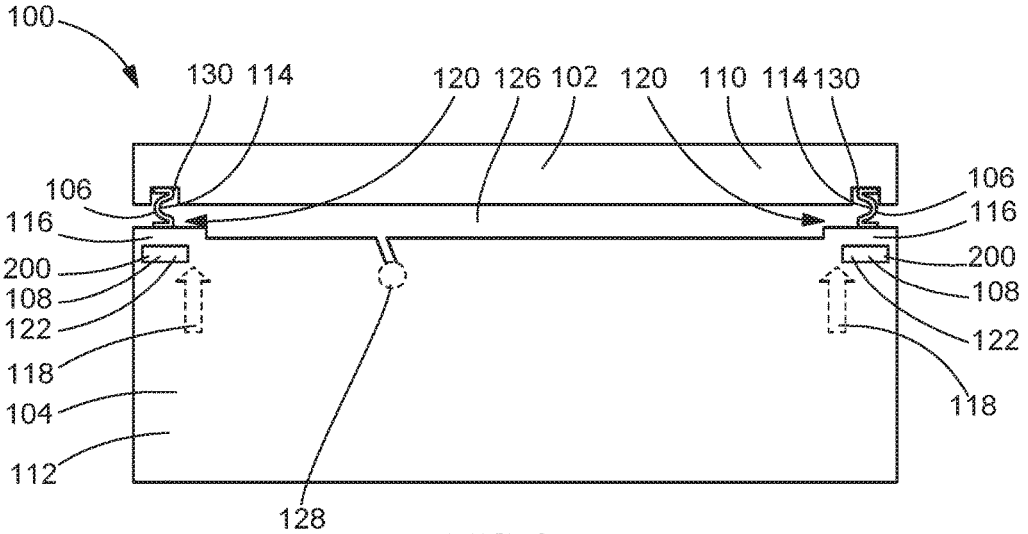
FIG. 2 is a schematic sectioned view of an apparatus including closed channels, according to an embodiment of the present disclosure.

Referring to FIGS. 1 and 2, in one embodiment, an apparatus 100 includes a first article 102, a second article 104, a sealing member 106 and a thermal break 108. The first article 102 includes a first material composition 110 having a first thermal tolerance. The second article 104 includes a second material composition 112 having a second thermal tolerance greater than the first thermal tolerance. The sealing member 106 is disposed between and contacts the first article 102 and the second article 104, and includes a third material composition 114 having a third thermal tolerance less than the second thermal tolerance. The third thermal tolerance is less than an operating temperature of the second article 104. The thermal break 108 is defined by the second article 104, and is proximate to the sealing member 106 and partitioned from the sealing member 106 by a portion 116 of the second article 104. The thermal break 108 interrupts a thermal conduction path 118 from the second article 104 to the sealing member 106. The first article 102 and the second article 104 compress the sealing member 106, forming a thermal gradient-tolerant seal 120. As used herein, "thermal tolerance" refers to the temperature at which material properties relevant to the operating of the apparatus 100 are degraded to a degree beyond the useful material capability (or required capability).

The first material composition 110 may be any suitable material, including a metal, a nickel-based alloy, a superalloy, a nickel-based superalloy, an iron-based alloy, a steel alloy, a stainless steel alloy, a cobalt-based alloy, a titanium alloy, or a combinations thereof.

The second material composition 112 may be any suitable material, including, but not limited to, a refractory metal, a superalloy, a nickel-based superalloy, a cobalt-based superalloy, a ceramic matrix composite, or a combination thereof. The ceramic matrix composite may include, but is not limited to, a ceramic material, an aluminum oxide-fiber-reinforced aluminum oxide (Ox/Ox), carbon-fiber-reinforced carbon (C/C), carbon-fiber-reinforced silicon carbide (C/SiC), and silicon-carbide-fiber-reinforced silicon carbide (SiC/SiC).

The third material composition 114 may be any suitable material, including, but not limited to, a nickel alloy, a titanium alloy, a nickel superalloy, INCONEL 718, René 41, a steel alloy, or combinations thereof.

As used herein, "René 41" refers to an alloy including a composition, by weight, of about 19% chromium, about 9.75% molybdenum, about 11% cobalt, about 1.6% aluminum, about 3.15% titanium, and a balance of nickel.

As used herein, "INCONEL 718" refers to an alloy including a composition, by weight, of about 52.5% nickel, about 19% chromium, about 3% molybdenum, about 5.1% niobium, about 1% cobalt, about 0.35% manganese, about 0.5% copper, about 0.9% aluminum, about 0.3% titanium, about 3.5% silicon, and a balance of iron.

The sealing member may be any suitable elastic seal. As used herein, "elastic" refers to the property of being biased to return toward an original conformation (although not necessarily all of the way to the original conformation) following deformation, for example, by compression. Suitable elastic seals include, but are not limited to, w-seals, v-seals, e-seals, corrugated seals, spring-loaded seals, spring-loaded spline seals, and combinations thereof.

In one embodiment, the thermal break 108 includes a channel 122. The channel 122 may include any suitable cross-sectional conformation, including, but not limited to circular, elliptical, oval, triangular, quadrilateral, rectangular, square, pentagonal, irregular, or a combination thereof. The edges of the channel 122 may be straight, curved, fluted, or a combination thereof.

The channel 122 may be an open channel 124 (as shown in FIG. 1) or a closed channel 200 (as shown in FIG. 2). As used herein, an "open channel" is a channel 122 in which at least a portion of the channel 122 is open to the outside environment. As used herein, a "closed channel" is a channel 122 which is hermetically sealed from the outside environment. The channel 122, whether an open channel 124 or a closed channel 200, may include any suitable cross sectional conformation.

In one embodiment (not shown), a closed channel 200 is arranged and configured to receive and transmit a flow of a cooling fluid. The closed channel may be connected to and in fluid communication with a cooling fluid source, for example, gas from a compressor, which flows any suitable cooling fluid through the closed channel 200, enhancing the effectiveness of the thermal break 108. The cooling fluid may be any suitable cooling fluid, including, but not limited to, air. In a further embodiment, the closed channel 200 may include turbulators, such as, but not limited to, pins, pin banks, fins, bumps, and surface textures. The inclusion of turbulators may further enhance the effectiveness of the thermal break 108.

In one embodiment, the channel 122 includes an insulator. The insulator may be any suitable material, article, or condition which thermally insulates the portion 116 of the second article 104 proximate to the sealing member 106 from the remainder of the second article 104 by breaking the thermal conduction path 118, and which thereby thermally insulates the sealing member 106 from the second article 104. "Insulate" as used herein is construed to include partial insulation. The insulator may include, but is not limited to, air, inert gas, ceramics, insulating foam, an evacuated volume, or a combination thereof.

In one embodiment, the thermal gradient-tolerant seal 120 defines an interface volume 126. The interface volume 126 is enclosed by the first article 102, the second article 104, and the sealing member 106. The interface volume 126 may be filled with static fluid, may be in fluid communication with a cooling channel 128 disposed in the first article 102 (FIG. 1), or may be in fluid communication with a cooling channel 128 disposed in the second article 104 (FIG. 2).

Figure 3:
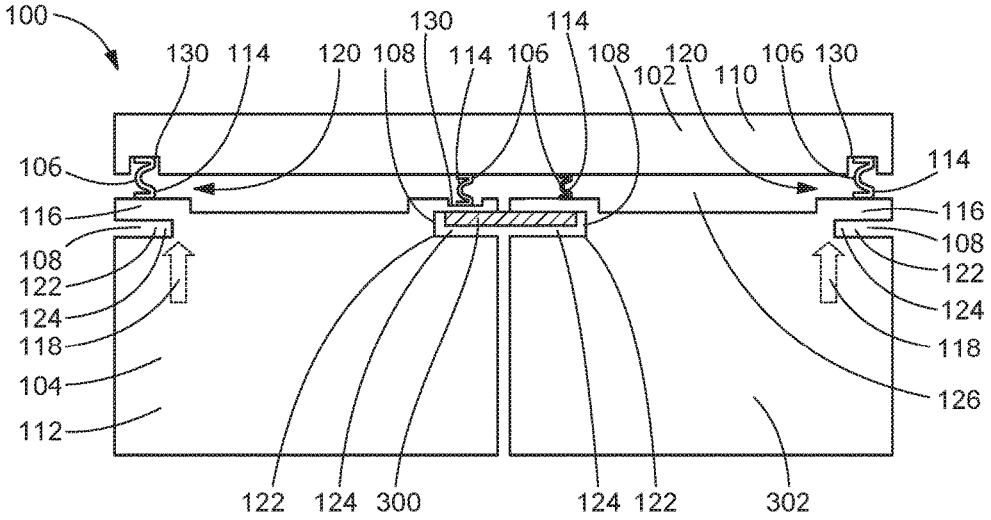
FIG. 3 is a schematic sectioned view of an apparatus including a fitted seal, according to an embodiment of the present disclosure.

Referring to FIG. 3, in one embodiment, a portion of the sealing member 106 is disposed within a recess 130 disposed in at least one of the first article 102. In another embodiment, a portion of the sealing member 106 is disposed within a recess 130 disposed in at least one of the second article 104. In yet another embodiment, portions of the sealing member 106 are disposed in recesses 130 disposed in each of the first article 102 and the second article 104. In an alternate embodiment, no portions of the sealing member 106 are disposed within a recess (for example, the sealing member 106 which is third from the left in FIG. 3).

The channel 122 may include a fitted seal 300 disposed within the channel 122. The fitted seal 300 may be partially or wholly disposed within the channel 122. The fitted seal 300 may be any suitable seal, including, but not limited to, a spline seal or a circumferential seal. The fitted seal 300 may include any suitable material, including, but not limited to, a nickel-based superalloy, a ceramic, HAYNES 188, or a combination thereof. In one embodiment, the thermal break 108 cooperates with an adjacent thermal break 108 of an adjacent article 302 to receive and surround a fitted seal 300.

As used herein, "HAYNES 188" refers to an alloy including a composition, by weight, of about 22% chromium, about 22% nickel, about 0.1% carbon, about 3% iron, about 1.25% manganese, about 0.35% silicon, about 14% tungsten, about 0.03% lanthanum, and a balance of cobalt.

The apparatus 100 may be any suitable apparatus 100. In one embodiment, a suitable apparatus 100 is an apparatus 100 including a sealing member 106 disposed between and adjacent to a first article 102 and a second article 104, wherein the operating temperature of the second article exceeds the thermal tolerance of the sealing member 106. In a further embodiment the apparatus 100 is a turbine component, such as, but not limited to, a nozzle 400 or a shroud 600.

Figure 4:
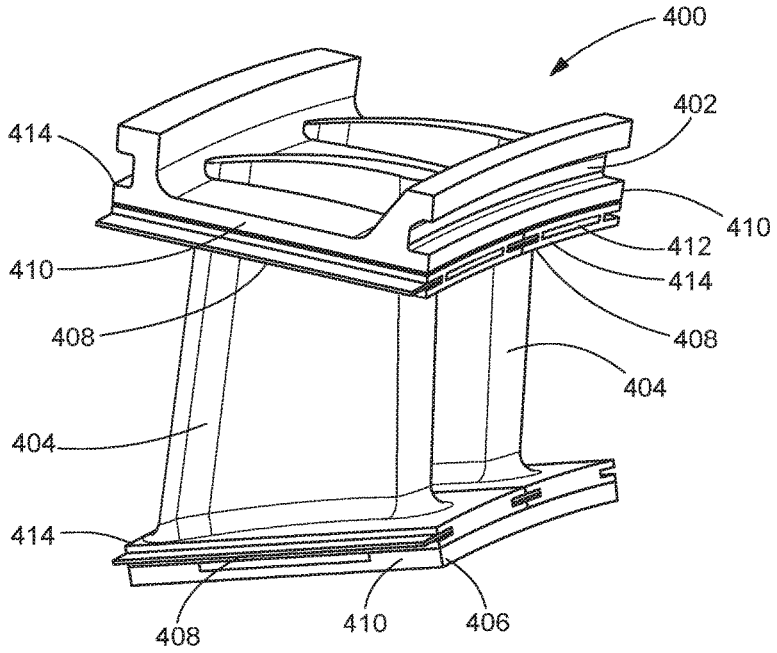
FIG. 4 is a perspective view of a turbine nozzle, according to an embodiment of the present disclosure.

Referring to FIG. 4, in one embodiment e apparatus 100 is a turbine nozzle 400. The turbine nozzle 400 includes an outside wall 402, a fairing 404 (or airfoil), and an inside wall 406.

Figure 5:
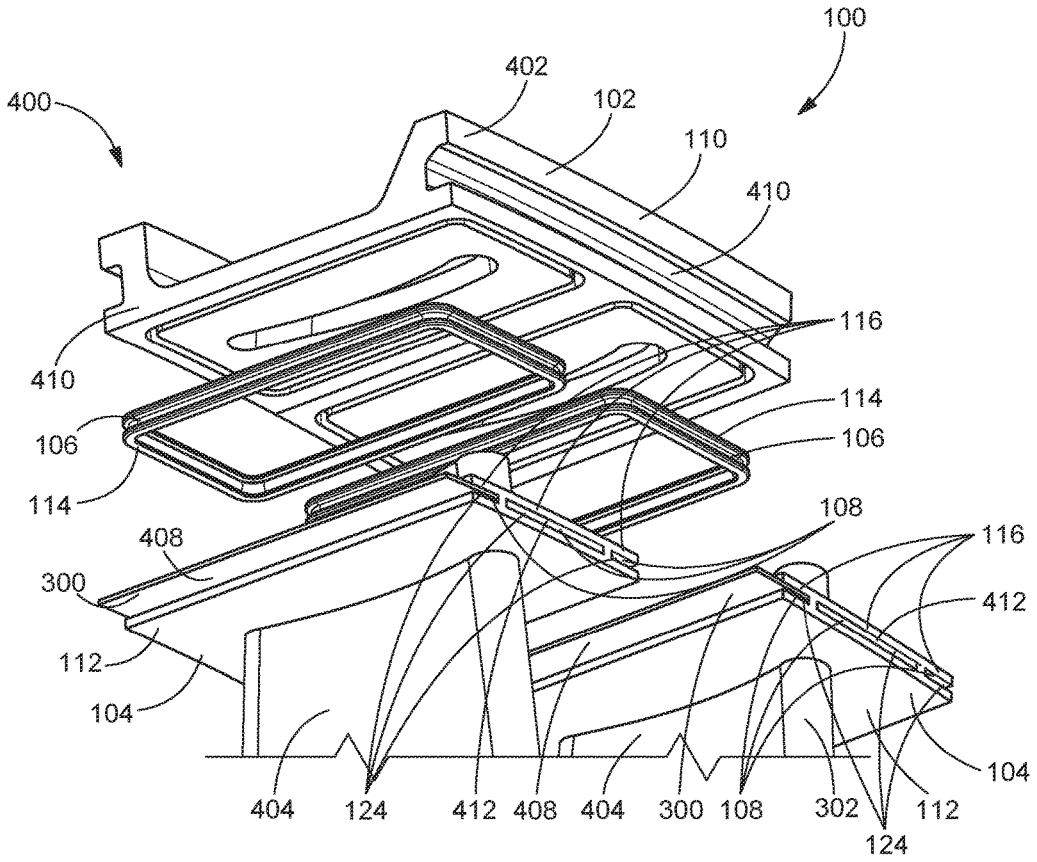
FIG. 5 is an enlarged exploded perspective view of the outside wall and fairing of the nozzle of FIG. 4, according to an embodiment of the present disclosure.

Referring to FIG. 5, in one embodiment, the outside wall 402 is the first article 102, the fairing 404 is the second article 104, and a sealing member 106 is disposed between the outside wall 402 and the fairing 404. The turbine nozzle 400 may include spline seals 408 disposed in open channels 124 along the lateral faces 410, and may, independently, include circumferential seals 412 disposed in open channels 124 along the circumferential faces 414.

Figure 6:
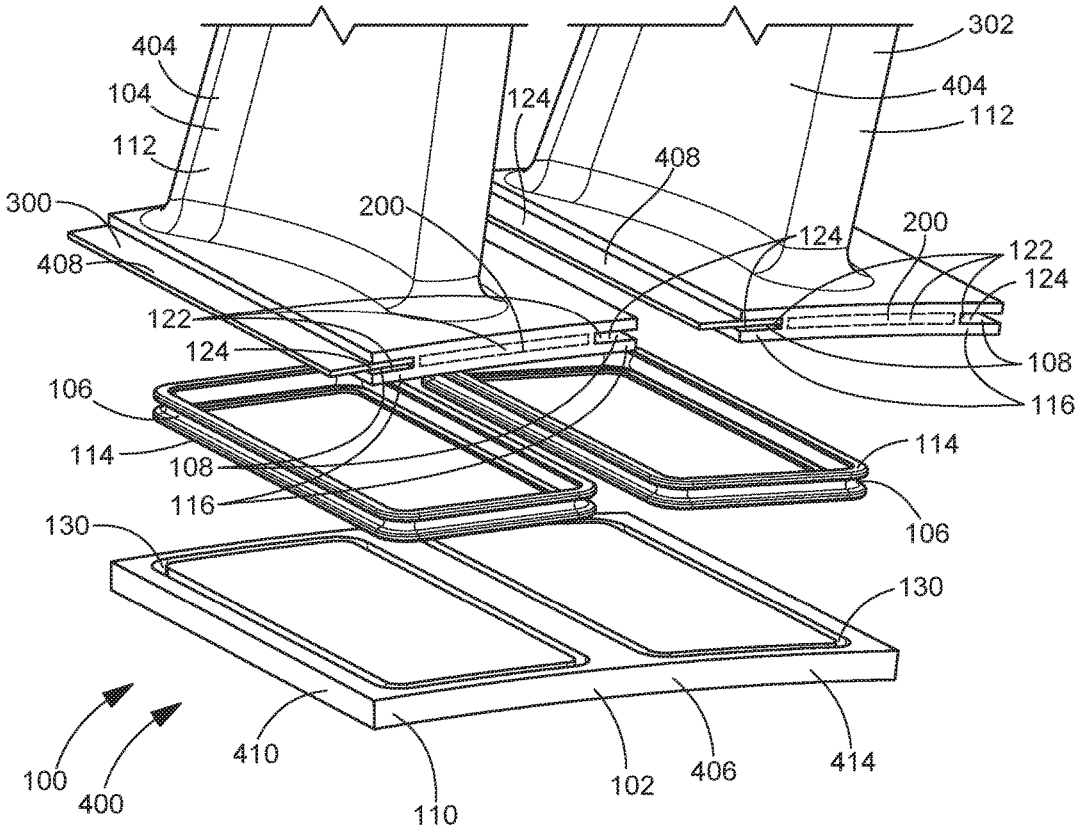
FIG. 6 is an enlarged exploded perspective view of the inside wall and fairing of the nozzle of FIG. 4, according to an embodiment of the present disclosure.

Referring to FIG. 6, in another embodiment, the inside wall 406 is the first article 102, the fairing 404 is the second article 104, and a sealing member 106 is disposed between the inside wall 406 and the fairing 404. The turbine nozzle 400 may include spline seals 408 disposed in open channels 124 along the lateral faces 410, and may, independently, include closed channels 200 along the circumferential faces 414.

Figure 7:
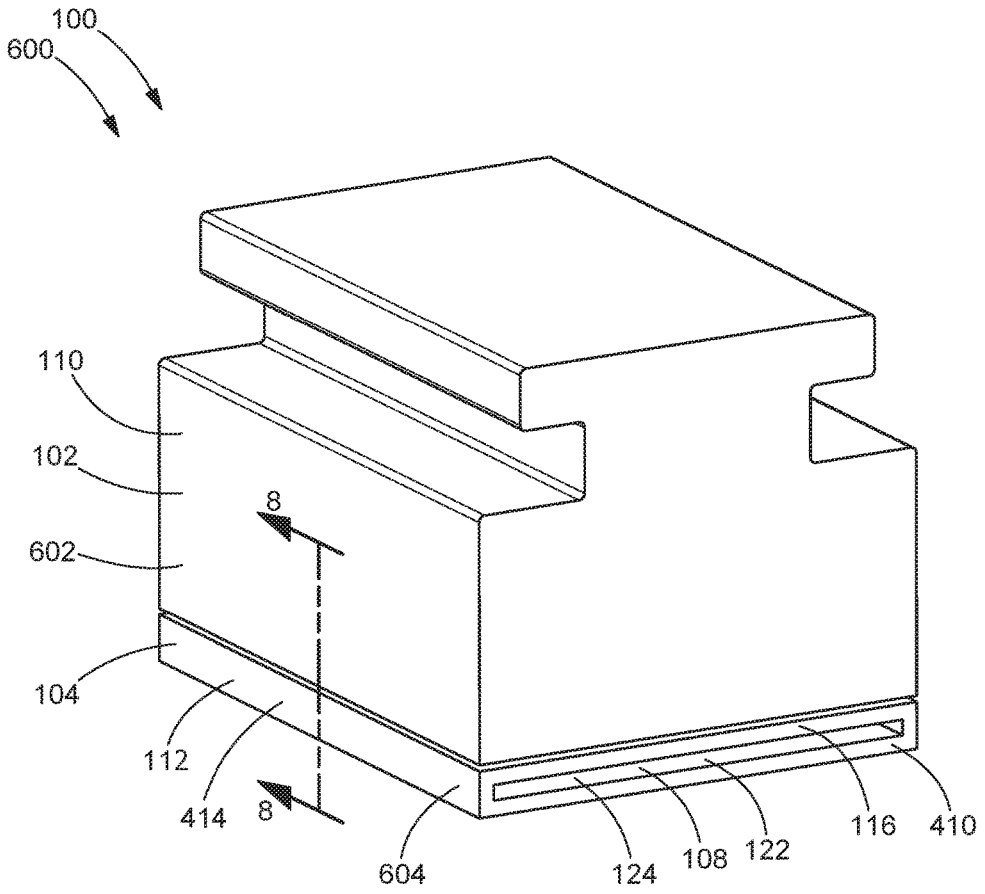
FIG. 7 is a perspective view of a turbine shroud, according to an embodiment of the present disclosure.
Figure 8:
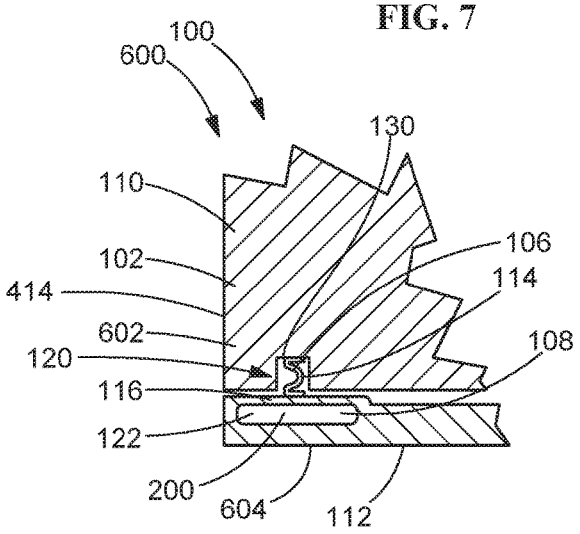
FIG. 8 is a sectional view along lines 8-8 of FIG. 7, according to an embodiment of the present disclosure.

Referring to FIG. 7, in one embodiment, the apparatus 100 is a turbine shroud 600. The turbine shroud 600 includes an outer shroud 602 and an inner shroud 604. The outer shroud 602 is the first article 102, and the inner shroud 604 is the second article 104. The turbine shroud 600 may include spline seals 408 (not shown in this instance) disposed in open channels 124 along the lateral faces 410. Referring to FIG. 8, the turbine shroud 600 includes sealing members 106 disposed between the outer shroud 602 and the inner shroud 604 along the circumferential faces 414.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus, comprising:

a first article, the first article including a first material composition having a first thermal tolerance;

a second article, the second article including a second material composition having a second thermal tolerance greater than the first thermal tolerance;

a sealing member disposed between and contacting the first article and the second article, the sealing member including a third material composition having a third thermal tolerance less than the second thermal tolerance, the third thermal tolerance being less than an operating temperature of the second article; and a thermal break defined by the second article, the thermal break proximate to the sealing member and partitioned from the sealing member by a portion of the second article, the thermal break interrupting a thermal conduction path from the second article to the sealing member, wherein the first article and the second article compress the sealing member, forming a thermal gradient-tolerant seal, wherein the sealing member includes a cross-sectional width along the first article and the second article, and the cross-sectional width of the sealing member is disposed entirely radially outward or radially inward of the thermal break and is partitioned entirely from the thermal break by the portion of the second article, and wherein the sealing member contacts the second article only at the portion of the second article.

2. The apparatus of claim 1, wherein the apparatus is a turbine component.

3. The apparatus of claim 2, wherein the turbine component is a nozzle, the first article is an outside wall, and the second article is a fairing.

4. The apparatus of claim 2, wherein the turbine component is a nozzle, the first article is an inside wall, and the second article is a fairing.

5. The apparatus of claim 2, wherein the turbine component is a shroud, the first article is an outer shroud, and the second article is an inner shroud.

6. The apparatus of claim 1, wherein the first material composition is a metal.

7. The apparatus of claim 1, wherein the second material composition is a ceramic matrix composite.

8. The apparatus of claim 1, wherein the sealing member is selected from the group consisting of w-seals, v-seals, e-seals, corrugated seals, spring-loaded seals, spring-loaded spline seals, and combinations thereof.

9. The apparatus of claim 1, wherein the thermal break includes a channel.

10. The apparatus of claim 9, wherein the channel includes an insulator.

11. The apparatus of claim 9, wherein the channel is an open channel.

12. The apparatus of claim 11, wherein the thermal break further includes a fitted seal disposed within the channel.

13. The apparatus of claim 12, wherein the thermal break cooperates with an adjacent thermal break of an adjacent article to receive and surround a fitted seal.

14. The apparatus of claim 9, wherein the channel is a closed channel.

15. The apparatus of claim 14, wherein the channel is arranged and configured to receive and transmit a flow of a cooling fluid.

16. The apparatus of claim 1, wherein the thermal gradient-tolerant seal defines an interface volume, the interface volume being enclosed by the first article, the second article and the sealing member, the interface volume being in fluid communication with a cooling channel disposed in the first article.

17. The apparatus of claim 1, wherein a portion of the sealing member is disposed within a recess disposed in at least one of the first article and the second article.

18. A turbine nozzle, comprising:

an outside wall, the outside wall including a metal having a first thermal tolerance;

a fairing, the fairing including a ceramic matrix material composite having a second thermal tolerance greater than the first thermal tolerance;

a sealing member disposed between and contacting the outside wall and the fairing, the sealing member including a third material composition having a third thermal tolerance less than the second thermal tolerance, the third thermal tolerance being less than an operating temperature of the fairing; and a thermal break defined by the fairing as a channel, the thermal break proximate to the sealing member and partitioned from the sealing member by a portion of the fairing, the thermal break interrupting a thermal conduction path from the fairing to the sealing member, wherein the outside wall and the fairing compress the sealing member, forming a thermal gradient-tolerant seal, wherein the sealing member includes a cross-sectional width along the outside wall and the fairing, and the cross-sectional width of the sealing member is disposed entirely radially outward or radially inward of the thermal break and is partitioned entirely from the thermal break by the portion of the fairing, and wherein the sealing member contacts the fairing only at the portion of the fairing.

19. The turbine nozzle of claim 18, wherein the thermal gradient-tolerant seal defines an interface volume, the interface volume being enclosed by the outside wall, the fairing and the sealing member, the interface volume being in fluid communication with a cooling channel disposed in the outside wall.

20. A turbine shroud, comprising:

an outer shroud, the outer shroud including a metal having a first thermal tolerance;

an inner shroud, the inner shroud including a ceramic matrix material composite having a second thermal tolerance greater than the first thermal tolerance;

a sealing member disposed between and contacting the outer shroud and the inner shroud, the sealing member including a third material composition having a third thermal tolerance less than the second thermal tolerance, the third thermal tolerance being less than an operating temperature of the inner shroud; and a thermal break defined by the inner shroud as a channel, the thermal break proximate to the sealing member and partitioned from the sealing member by a portion of the inner shroud, the thermal break interrupting a thermal conduction path from the inner shroud to the sealing member, wherein the outer shroud and the inner shroud compress the sealing member, forming a thermal gradient-tolerant seal, wherein the sealing member includes a cross-sectional width along the outer shroud and the inner shroud, and the cross-sectional width of the sealing member is disposed entirely radially outward or radially inward of the thermal break and is partitioned entirely from the thermal break by the portion of the inner shroud, and wherein the sealing member contacts the inner shroud only at the portion of the inner shroud.

* * * * *